US005175560A

United States Patent [19]

Lucas et al.

[11] Patent Number: 5,175,560

[45] Date of Patent: Dec. 29, 1992

[54] NOTCH RADIATOR ELEMENTS

[75] Inventors: Eric W. Lucas, Ellicott City; Michael A. Mongilio, Columbia; Kenneth M. Leader, Glen Burnie, all of Md.; Charles P. Stieneke, Cary, N.C.; John W. Cassen, Sykesville, Md.

[73] Assignee: Westinghouse Electric Corp., Pittsburgh, Pa.

[21] Appl. No.: 674,003

[22] Filed: Mar. 25, 1991

[51] Int. Cl.[5] ..... H01Q 13/10

[52] U.S. Cl. ..... 343/767; 343/770

[58] Field of Search ..... 343/770, 767, 771, 795, 343/786

[56] References Cited

U.S. PATENT DOCUMENTS

| | | | |
|---|---|---|---|
| 4,001,834 | 1/1977 | Smith | 343/795 |
| 4,353,072 | 10/1982 | Monser | 343/786 |
| 4,573,056 | 2/1986 | Dudome et al. | 343/795 |
| 4,672,384 | 6/1987 | Roy et al. | 343/786 |
| 5,023,623 | 6/1991 | Kreinheder et al. | 343/767 |

*Primary Examiner*—Michael C. Wimer

*Attorney, Agent, or Firm*—Thomas H. Martin

[57] ABSTRACT

A planar dielectric substrate supports a stripline conductor therein. A conductive housing has one or more recesses for receiving a dielectric and a conductive cover is mountable over the dielectric in contact with the housing to enclose the dielectric and isolate the stripline from adjacent structures. The housing and cover have aligned slots disposed on opposite sides of the dielectric and transverse to the stripline for providing coupling of signals between the stripline and the slot. An aperture is formed in the housing in communication with the slot.

Other embodiments of the invention include impedance matching means for either or both of the stripline and the aperture for optimizing the efficiency measured in terms of VSWR of the radiator.

20 Claims, 3 Drawing Sheets

NOTCH RADIATOR ELEMENTS

BACKGROUND OF THE INVENTION

1. Field of the Invention

The invention relates to notch radiator elements. In particular, the invention relates to high frequency notch radiator devices employing circuit elements in printed and machined arrangements for use in antenna arrays.

2. Description of the Prior Art

Known notch type radiator elements such as element 10 in FIG. 1 comprise a 50 ohm stripline 12 and a notch antenna 14. A double slot line tapered launch or aperture 16 has a narrow 50 ohm feed end 18 fed by the stripline 12 and a wide 376 ohm radiating aperture 20 which matches the air. The stripline 12 and the feed end 18 have respective quarter wavelength extensions 22 and 24 which form terminations for each. In the arrangement shown, the stripline 12 is buried within a dielectric substrate 26 and the aperture 16 is formed of etched metallized films on opposite sides of the substrate 26.

The radiator 10 is designed to transmit or receive RF signals. In the transmission mode, a signal carried by the stripline 12 sets up an electric field in the feed end 18 of the aperture 16. The electric field radiates outwardly and couples the signal to the air or other medium at the aperture end 20. Incoming signals are likewise coupled to the aperture 20 for ultimately producing an electric field in the stripline 12. The tapered wall 17 of the aperture 20 provides a transition between the standard 50 ohm stripline 12 and the 376 ohm (nominal) atmosphere. In known arrangements, a plurality of such elements are manufactured in continuous strip. Sometimes stray or extraneous fields are produced as a result of coupling inefficiencies and the like between the stripline 12 and the aperture 16.

Adjacent elements are electrically isolated for suppressing the stray fields by means of metallic shields 28 formed in vias 30 in the substrate 26. The shields 28 are in electrical contact with the metallized film forming the aperture 16 as shown.

In the known arrangements, difficulties have been encountered in obtaining desired bandwidth and impedance matching. Processing difficulties including shrinkage of the dielectric during manufacture results in some cumulative non-uniformities in arrangements employing an elongated dielectric board containing many elements. In addition, cross coupling between adjacent elements occurs as a result of signal leakage through the metallic shields 28.

SUMMARY OF THE INVENTION

The present invention is designed to obviate and eliminate the shortcomings and limitations of the described prior arrangements. In one embodiment of the invention a planar dielectric substrate supports a signal carrying element therein in the form of a stripline having a feed end. A conductive housing having an aperture therein receives the dielectric. A conductive cover also mountable in the recess over the dielectric and in contact with the housing encloses dielectric and isolates the stripline from adjacent structures. The housing and cover have aligned slots disposed on opposite sides of the dielectric and transverse to a portion of the stripline for providing coupling of signals between the stripline and the slot.

Other embodiments of the invention include an array of such radiators and impedance matching means in either or both of the stripline feed and the aperture for optimizing the efficiency measured in terms of VSWR of the radiator.

DESCRIPTION OF THE PREFERRED EMBODIMENT

Figure 2:
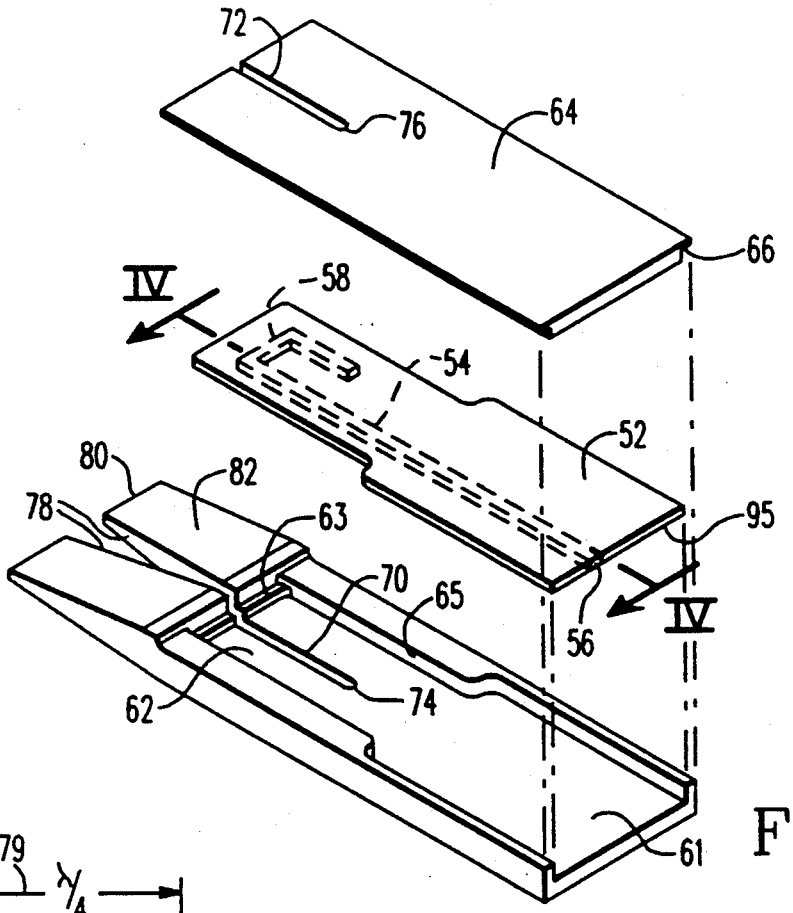
FIG. 2 is an exploded perspective view of a single element machined notch radiator according to the present invention.

Referring to FIG. 2 a single radiating element in accordance with present invention is illustrated in exploded prospective view. It should be understood, however, that a plurality of such elements 50 maybe provided in an array as hereinafter described. In the arrangement of FIG. 2, a dielectric substrate 52 has a stripline 54 embedded therein. The impedance of the stripline 54 is typically 50 ohm. The stripline 54 has a terminal end 56 for coupling signals thereto and a feed end 58 which extends transversely of the stripline 54. The length of the feed end 58 is one quarter wavelength ($\lambda/4$) of a selected frequency of interest. The dielectric 52 is shaped as shown and as hereinafter described. A planar conductive housing 60 having a stepped recess 61 receives the dielectric 52 in a lower portion 62 as illustrated. The shape of the dielectric 52 conforms to the shape of the lower portion 62. The stepped recess 61 has an upper portion 63 adjacent the lower portion 62 and a conductive cover 64 is adapted to be located in the upper portion 63 over the dielectric 52 and in electrical contact with the housing 60. The cover 64 has a mating surface 66 which is designed to mate with the upper portion 63 and contact side walls 65 of the housing 60. The side walls 65 isolate adjacent elements from spurious signals.

The housing 60 and the cover 64 have respective aligned elongated slots 70 and 72 as shown. The slots 70–72 are aligned axially of the housing 60 and cover 64. The dielectric 52 is located in the first recess portion 62 such that the feed end 58 of the stripline 54 lies transversely with respect to the slots 70–72.

Figure 3:
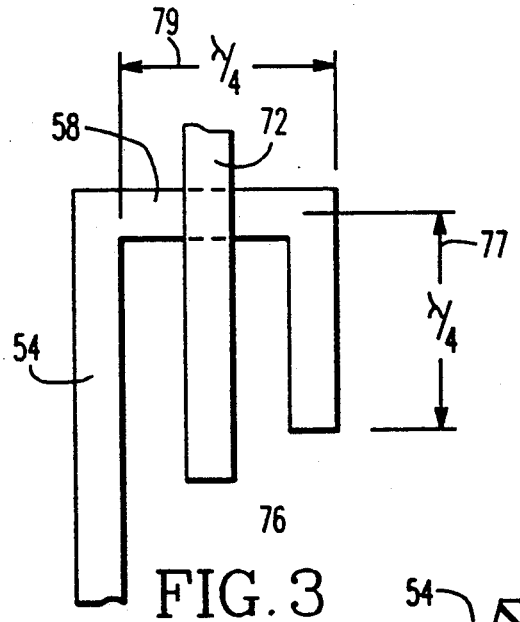
FIG. 3 is a fragmentary schematic illustrating a stripline feed end of a signal carrying means and an input end of a notch radiator.
Figure 4:
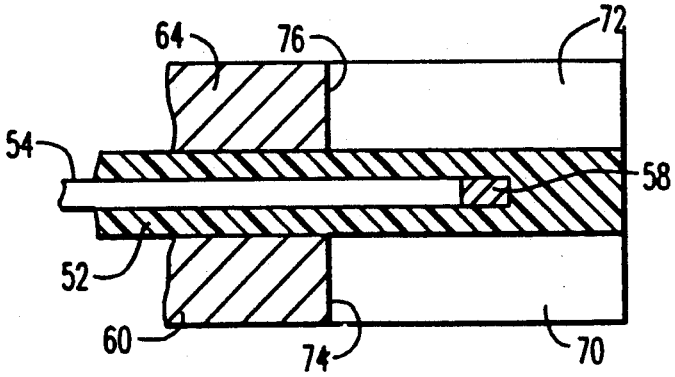
FIG. 4 is a cross-sectional view of a portion of the housing and cover and the substrate and signal carrying element taken along line IV—IV of FIG. 2.

Respective terminal ends 74–76 of the slots 70–72 lie one quarter wavelength from where the center of the feed end 58 crosses the slots 70–72 thereby forming quarter wavelength ( $\lambda/4$) extensions 77–79. See for example the schematic illustration in FIGS. 3 and 4 showing the geometrical relationship between the feed end 58 of the stripline 54 and the slots 70–72. The slots 70 and 72 are interconnected with a tapered aperture portion 78 formed in the housing 60 which extends from the slots 70–72 to a leading edge 80 of the element 50.

Figure 5:
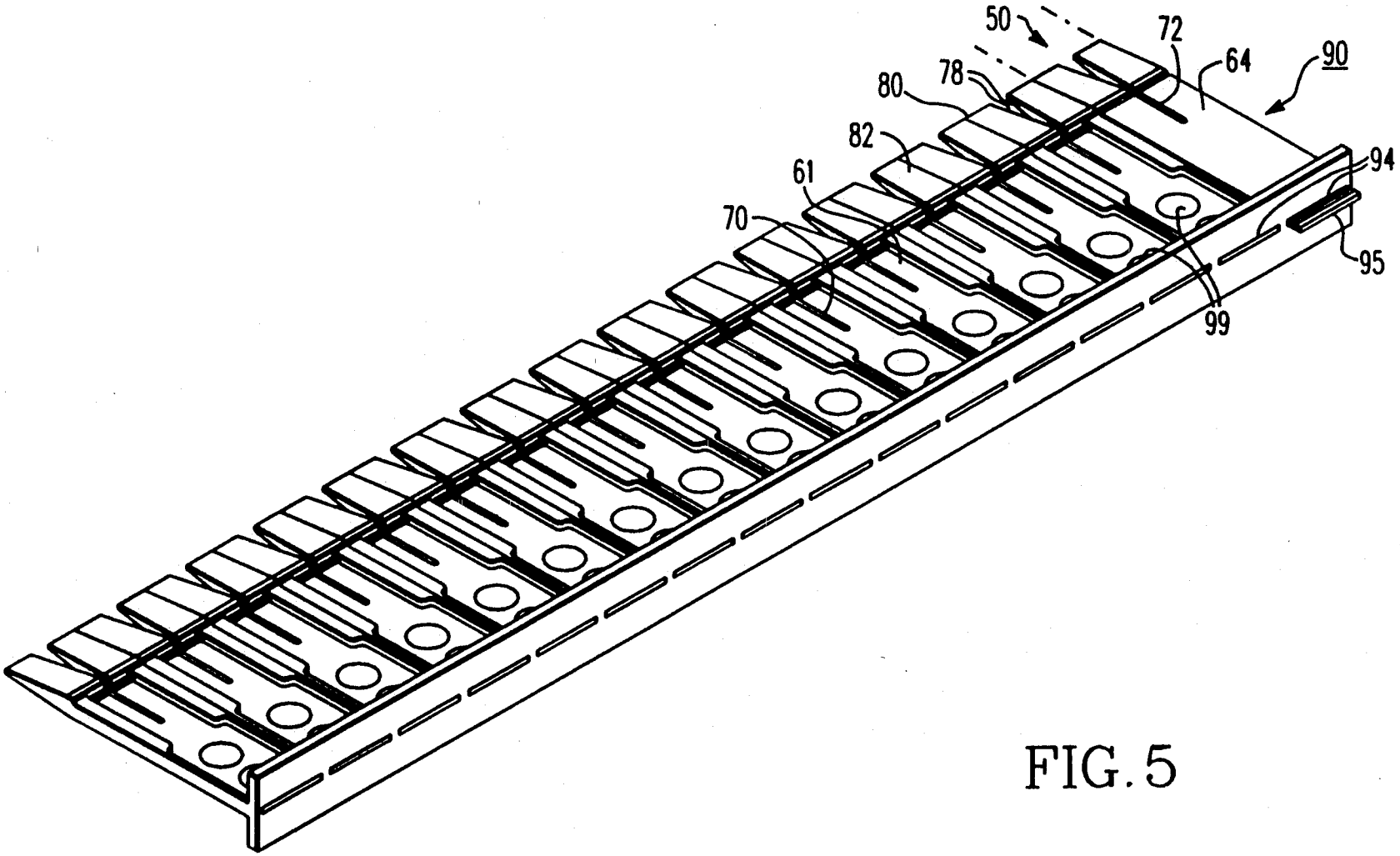
FIG. 5 is a perspective view of an array of radiators illustrated in FIG. 2.

FIG. 5 illustrates a plurality of elements 50 in an elongated array 90. In the arrangement, the dielectric 52 (FIG. 2) is located in the first recess portion 62 and the cover 64 is located in the second recess portion 63. The array 90 has a mounting flange 92 and slotted apertures 94 for receiving the terminal ends 95 of the dielectric 52 and the corresponding terminal end 56 of each of the striplines 54. The array 90 may be employed as part of a phased array transmit/receive antenna.

As shown in FIGS. 2 and 5, the output end 82 of each element 50 tapers as shown. The purpose of this taper is to reduce structural cross polarization reflections at the aperture. It has been found, however, that performance is not adversely affected when the output end 82 of the elements is optimally untapered or square which allows for ease of manufacture. In a preferred embodiment, the first and second recess portions 62, 63, the cover 64 and the optional tapered output end 82 are machined from aluminum stock. If desired one or more circulator chambers 99 may be provided as room permits. The slots 70–72 and tapered aperture portion 78 may be machined using an electric discharge machining (EDM) technique.

Figure 1:
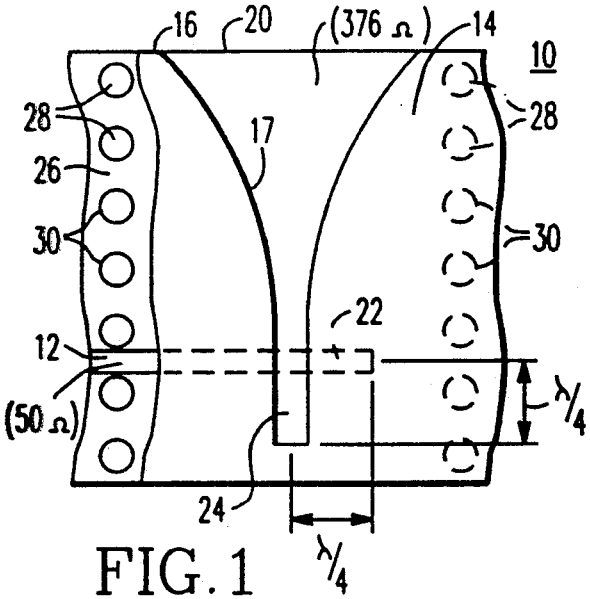
FIG. 1 PRIOR ART
FIG. 1 is a schematic plan view of a known notch radiator illustrative of the principle of operation of such devices.
Figure 6A:
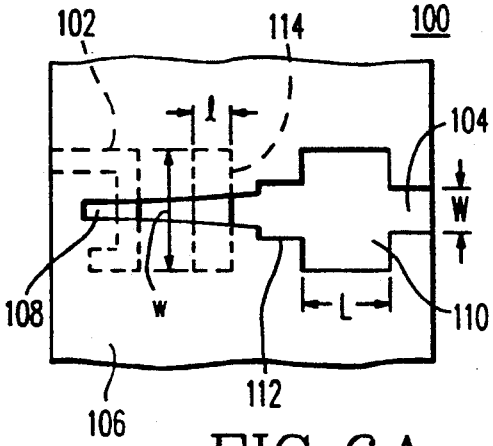
FIGS. 6A–6D are plan views of various notch radiators employing impedance matching according to the present invention.

FIG. 6A illustrates a matched bilateral slot line antenna element 100 according to another embodiment of the invention. In the arrangement illustrated, the stripline 102 feeds the aperture 104 in a manner similar to the arrangements hereinbefore described. However, the aperture 104 is formed of a conductor 106 having a narrow aperture launch portion or slot line transition 108 for launching the radiation, a relatively wide inductive notch or integrated matching discontinuity 110 and a step transition 112 therebetween. A floating septum 114 in the form of metallized film may be supported within the dielectric (not shown) in the same way as the stripline 102. The discontinuity 110 has a width W which controls the impedance and a length L which controls the resonance of the device. The values of L and W may be iteratively determined for optimum results. The transition 112 adds reactive impedance to the circuit for matching the slot line transition 108 with the discontinuity 110. The septum 114 may be sized both in its length 1 and width w to fine tune the reactive impedance of the discontinuity 110 in order to obtain the desired response. Typically, the desired response is a VSWR of 2:1 or lower over its bandwidth. The arrangement illustrated in FIG. 6A provides a somewhat narrow bandwidth of 8–12 GHz useful in some radar applications.

Figure 6B:
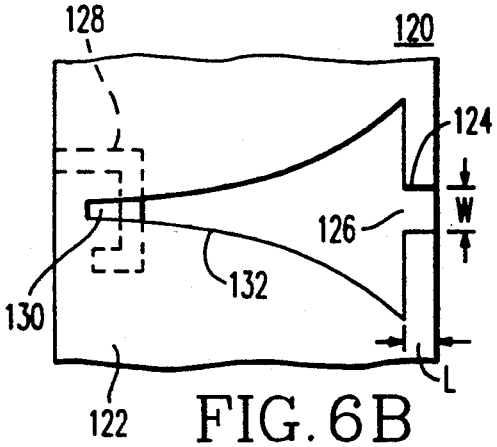

FIG. 6B illustrates an impedance matching antenna element 120 which employs a tapered notch radiator 122 having a reactive iris 124 located at the aperture/-free space discontinuity, that is, at the radiator output aperture 126. The stripline 128 feeds the slot line transition 130 which tapers outwardly along boundary 132 to the aperture 126. The iris 124 loads the antenna element 120 with an impedance which tunes the device. The width W of the aperture 126 controls the impedance and the length L controls the reactance. The iris 124 provides for a more symmetrical and centered output and reduces the VSWR over the bandwidth of the device.

Figure 6C:
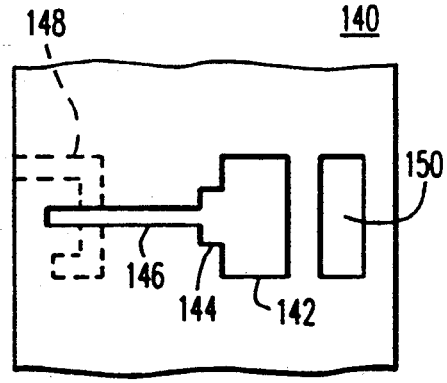

FIG. 6C illustrates a resonant antenna element 140 having an integrated matching discontinuity 142, a step transition 144 and a slot line transition 146 for launching a signal from the stripline 148. The arrangement is similar to FIG. 6A. A resonant cavity 150 is provided adjacent the discontinuity 142 for frequency control. The exact size and shape (i.e. square, rectangular or notched) of the resonant cavity may be determined in accordance with desired frequency of operation and other relevant parameters.

Figure 6D:
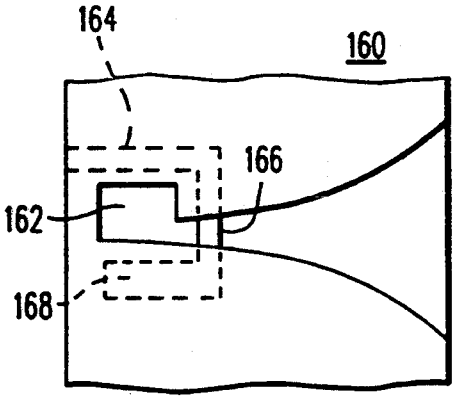

FIG. 6D illustrates an impedance matched element 160 in which the quarter wavelength extension 162 is widened to provide an increased impedance at the interface of the stripline 164 and the slot line transition 166. The stripline 164 is terminated with an open circuit stub 168. The arrangement broadens the response of the coupler from 8–12 GHz to about 13–18 GHz. The mismatch provided by the open aperture 162 and the open circuit stub 168 slightly raises the VSWR characteristic but not to an unacceptable level.

All the arrangements illustrated in FIGS. 6A—6D may be employed in the array illustrated in FIG. 2. The various apertures may be machined by various techniques including electrical discharge machining resulting in high precision apertures. The striplines in the various modified forms may be printed and encapsulated within the dielectric.

While there has been described what at present are believed to be the preferred embodiments of the present invention, it will be apparent to those skilled in the art the various changes and notifications may be made therein without departing from the invention, and is intended in the appended claims to cover all such modifications and changes that come within true spirit and scope of the invention.

What is claimed is:

1. A broadband radiator element for high frequency signals comprising:

a planar dielectric substrate;

at least one conductive strip supported within the substrate;

a planar housing formed of a rigid solid conductor having a recess therein for receiving the substrate therein, said conductor having an aperture in one end thereof for radiating signals in free space; and a rigid conductive cover mounted in the recess and over the substrate in contact with the housing for enclosing and electrically isolating the substrate and the conductive strip, said housing and cover having slots therein forming a slot line transition aligned with the aperture on opposite sides of the substrate in a direction transverse to a portion of the conductive strip and proximate thereto such that the slot line transition in the aperture represents a discontinuity with respect to the conductive strip and signals carried thereby cause a field to be induced in the slot for coupling said signals between the conductive strip and the aperture.

2. The radiator element of claim 1 wherein the conductive strip comprises a printed circuit element.

3. The radiator element of claim 2 wherein the conductive strip, the housing and the cover form a stripline.

4. The radiator element of claim 3 wherein the stripline is disposed transversely with respect to the slot.

5. The radiator element of claim 1 wherein the slot line transition extends from a terminal end thereof towards the aperture and impedance matching means is located between the terminal end of the slot line transition and the aperture.

6. The radiator element of the claim 5 wherein the impedance matching means comprises at least one discontinuity between the slot line transition and the aperture.

7. The radiator element of claim 5 wherein the impedance matching means comprises a plurality of discontinuities in the slot line transition.

8. The radiator element of claim 7 wherein the slot line transition comprises a first narrow slot transverse of the conductive strip for launching the signal induced by the field cooperating therewith, said slot having a width establishing a signal feed impedance;

a second wider step portion adjacent the aperture for reducing VSWR of the launched signal; and a third step portion sized between the slot and the second wider step portion and interconnecting the third and second portions for forming a transition impedance.

9. The radiator element of claim 8 further including a conductive element in the dielectric substrate forming a floating septum located adjacent the slot for providing additional transition impedance.

10. The radiator element of claim 9 wherein the floating system comprises a conductive strip lying adjacent the signal launching conductive strip.

11. The radiator element of claim 1 further comprising a resonant cavity spaced between the slot line transition and the aperture.

12. The radiator element of claim 1 wherein the slot line transition extends from a terminal end towards the aperture and impedance mismatching means is formed adjacent to the terminal end of the slot line transition for increasing the bandwidth of the radiator element.

13. The radiator element of claim 12 wherein the impedance mismatching means is located between the carrying conductive strip and the terminal end of the slot line transition and is formed of a widened portion of the said slot line transition increasing the impedance thereof.

14. The radiator element of claim 13 wherein the impedance mismatching means includes a relatively wide conductive end portion of the conductive strip being widened to increase the impedance thereof.

15. The radiator element of claim 14 wherein the widened portion is an open circuit at a frequency of interest.

16. The radiator element of claim 1 wherein the substrate comprises a pair of planar members and the conductive strip is sandwiched between the planar members.

17. The radiator element of claim 1 wherein the recess is formed with lateral side walls for suppressing spurious signals laterally of the housing.

18. The radiator element of claim 1 wherein the housing and cover are machined from solid metal stock.

19. An antenna array for high frequency signals comprising:

a plurality of planar dielectric substrates;

a conductive strip supported within each substrate;

an elongated rigid member formed of a solid conductor having a plurality of machined recesses therein, each recess for receiving a corresponding substrate therein, said member having a machined aperture for each conductive strip for radiating signals; and a rigid conductive machined cover for each recess mounted in the recess and over the corresponding substrate in contact with the housing for enclosing the substrate and the conductive strip, said housing and cover having a pair of machined slots for each conductive strip forming a plurality of slot line transitions aligned with each corresponding aperture on opposite sides of each substrate in a direction transverse to a portion of the corresponding conductive strip and proximate thereto such that each slot line transition represents a discontinuity with respect to the conductive strip and signals carried thereby cause a field to be induced in the slots for coupling signals between each conductive strip and each corresponding aperture.

20. The array of claim 19 wherein the lateral walls of each recess shield adjacent conductive strips from extraneous signals.

* * * * *